US006061883A

United States Patent [19]

Uehara

[11] Patent Number: 6,061,883

[45] Date of Patent: May 16, 2000

[54] BUCKLE

[75] Inventor: Ryoichiro Uehara, Toyama-ken, Japan

[73] Assignee: YKK Corporation, Tokyo, Japan

[21] Appl. No.: 09/290,832

[22] Filed: Apr. 13, 1999

[30] Foreign Application Priority Data

Apr. 30, 1998 [JP] Japan ..... 10-137542

[51] Int. Cl.[7] ..... A44B 11/00

[52] U.S. Cl. ..... 24/625; 24/615; 24/637

[58] Field of Search ..... 24/625, 634, 635, 24/637, 615, 616, 618

[56] References Cited

U.S. PATENT DOCUMENTS

| | | | |
|---|---|---|---|
| 4,642,857 | 2/1987 | Ono | 24/637 |
| 4,793,032 | 12/1988 | Crowle | 24/625 |
| 5,113,556 | 5/1992 | Murai et al. | 24/615 |
| 5,311,649 | 5/1994 | Suh | 24/635 |
| 5,604,964 | 2/1997 | Aoshima . | |
| 5,606,783 | 3/1997 | Gillis et al. | 24/637 |
| 5,709,014 | 1/1998 | Takahashi | 24/615 |

FOREIGN PATENT DOCUMENTS

| | | |
|---|---|---|
| 0 492 221 | 7/1992 | European Pat. Off. . |
| 8-89314 | 4/1996 | Japan . |
| 2 295 198 | 5/1996 | United Kingdom . |

*Primary Examiner*—Victor N. Sakran
*Attorney, Agent, or Firm*—Hill & Simpson

[57] ABSTRACT

The present invention provides a buckle having a simple structure to increase efficiency of an assembling operation and desirable operability wherein engagements of plugs with a socket are reliably carried out. The buckle comprises a pair of plugs and a socket. Each the plug has a strap attaching portion, a tongue formed to project from the strap attaching portion to be inserted into the socket, and an engaging portion. The socket is formed with inserting portions into which the tongues are inserted respectively, and fixed engaged portions with which the engaging portions are engaged. An operating portion is formed separately from the socket between the engaged portions for displacing the engaging portions to-disengage engagements of the engaging portions with the engaged portions. The operating portion comprises an operating chip exposed to an outer surface of an operating hole of the socket, pushing portions integrally formed on a rear face side of the operating chip, and a locking portion to be locked at the socket. Resilient portions are formed on at least one of the operating chip and the socket so as to abut on the other of the operating chip and the socket and to bias the operating portion outward.

5 Claims, 8 Drawing Sheets

BUCKLE

BACKGROUND OF THE INVENTION

1. Field of the Invention

The present invention relates to a buckle having a three-way strap and used for securing a human body and the like.

2. Description of the Related Art

Conventionally, a buckle mounted to each coupling end portion of a three-way strap comprises a pair of plugs and a socket into and with which the pair of plugs are inserted and engaged. A through hole in a predetermined shape is formed in the socket. An operating portion for resiliently deforming the engaged buckles for disengagement is formed in the through hole. The operating portion is integrally formed at a tip end of a hinge portion which is a resilient portion formed integrally with the socket.

An engaging operation of such a buckle is reliably carried out by inserting the plugs into inserting holes of the socket and pushing the plugs against a resilient force generated in the engagements. In order to pull the plugs out of the socket, the operating portion such as a lock canceling button of the socket is pushed. Thus, the engagements between engaged portions of the plugs and the socket are disengaged, thereby the pair of plugs can be pulled out of the socket.

In the case of above prior art, because the operating portion such as the lock canceling button of the socket has a cantilevered structure wherein the operating portion is formed via the hinge portion which is integral with the socket, a sufficient spring strength can not be obtained. Thus, clothes or other members may be caught in the through hole wherein the lock canceling button is positioned, and the lock canceling button may be stripped off outward and broken. Also, displacement when the operating portion is pushed is not equal and the displacement is larger at a portion farther from the hinge portion. Therefore, the engagement of one of the pair of plugs with larger displacement disengages earlier. As a result, there may be a dispersion of feelings at the time of disengagement.

A buckle wherein displacement of the operating chip is equal is disclosed in Japanese Patent Application Laid-open Publication No. 8-89314. In this buckle, a lock member as an operating portion is separated from a socket. Two resilient leg portions projecting diagonally downward are formed at a bottom face of the lock member to abut on an inner side of a bottom face of the socket, and the lock member can be supported for projecting and sinking movements. In this buckle, both sides of the lock member can be evenly displaced by the pair of resilient leg portions.

However, because engaging portions for engagement with the plugs are formed integrally with the lock member, if "wear-out" or the like is generated in the resilient leg portions, firm and stable engagements between the plugs and the socket are hindered. Also, because the engaging portions are formed to project from opposite sides of the lock member, the lock member itself is larger than a through hole of the socket. Therefore, in assembling, the lock member is required to be inserted through the inserting hole with the resilient leg portions being resiliently deformed, thereby efficiency of the operation decreased.

SUMMARY OF THE INVENTION

The present invention has been accomplished with above prior art in view, and it is an object of the invention to provide a buckle having a simple structure to increase efficiency of an assembling operation and desirable operability wherein engagements of plugs with a socket are reliably carried out.

To achieve the above object, according to the invention, there is provided a buckle comprising a pair of plugs respectively mounted to end portions of a pair of straps, a socket mounted to an end portion of another strap, a strap attaching portion formed at a base portion of each of the plug, a tongue projecting from the strap attaching portion and to be inserted into the socket, an engaging portion formed at a tip end portion of each the tongue, a pair of inserting portions which are formed in the socket to penetrate the socket and to face each other and into which the tongues are inserted respectively, fixed engaged portions which are formed in the inserting portions and with which the engaging portions of the plugs are engaged, and an operating portion which is formed between the engaged portions and which displaces the engaging portions to disengage the engaging portions with the engaged portions.

The operating portion is formed separately with the socket and comprises an operating chip or release button exposed to an outer surface of an operating hole of the socket, pushing portions integrally formed on a rear face side of the operating chip, and a locking portion to be locked in the socket to prevent disengage from the socket. A resilient portion extending toward a rear face side of the socket is formed at the operating chip such that a tip end of the resilient portion abuts on the socket to bias the operating chip toward an outside of the socket. A pair of resilient portions are formed symmetrically with respect to the operating chip.

A pair of guide walls for guiding opposite sides of the pair of resilient portions are formed on the rear face side of the socket, and contact surfaces on which the tip ends of the resilient portions abut and which are slopes for plastically deforming the resilient portions are formed between the pair of guide walls. The resilient portions may be formed on the rear face side of the socket. In that case, the guide walls and the contact surfaces are formed at the operating chip.

The locking portion extends toward a bottom face side of the socket, a through hole is formed in the rear face of the socket into which the locking portion is to be fitted can project and sink freely, and the locking portion is formed to be locked on an inner side face of the through hole.

In the buckle of this invention, because the operating portion is formed separately from the socket, the operating portion can be mounted to the socket by inserting the operating portion into the operating hole of the socket from above. The resilient portions for operating the operating portion and resilient engagement at the time of engagements of the socket with the plugs are respectively formed by different structures. Because the resilient portions are disposed symmetrically with respect to the operating chip, displacement when the operating chip is pushed is equal, and tongues of the pair of plugs are substantially simultaneously pushed with the same force and are resiliently deformed similarly to each other. Then, the engaging portions of each the tongue are separated from the engaged portions of the socket to be disengaged. At this time, because the tip end portions of the tongues are pushed by the pushing portions of the operating portion, the plugs are pushed outside the socket that the pair of plugs jump out of the socket substantially simultaneously.

DESCRIPTION OF THE PREFERRED EMBODIMENT

Figure 1:
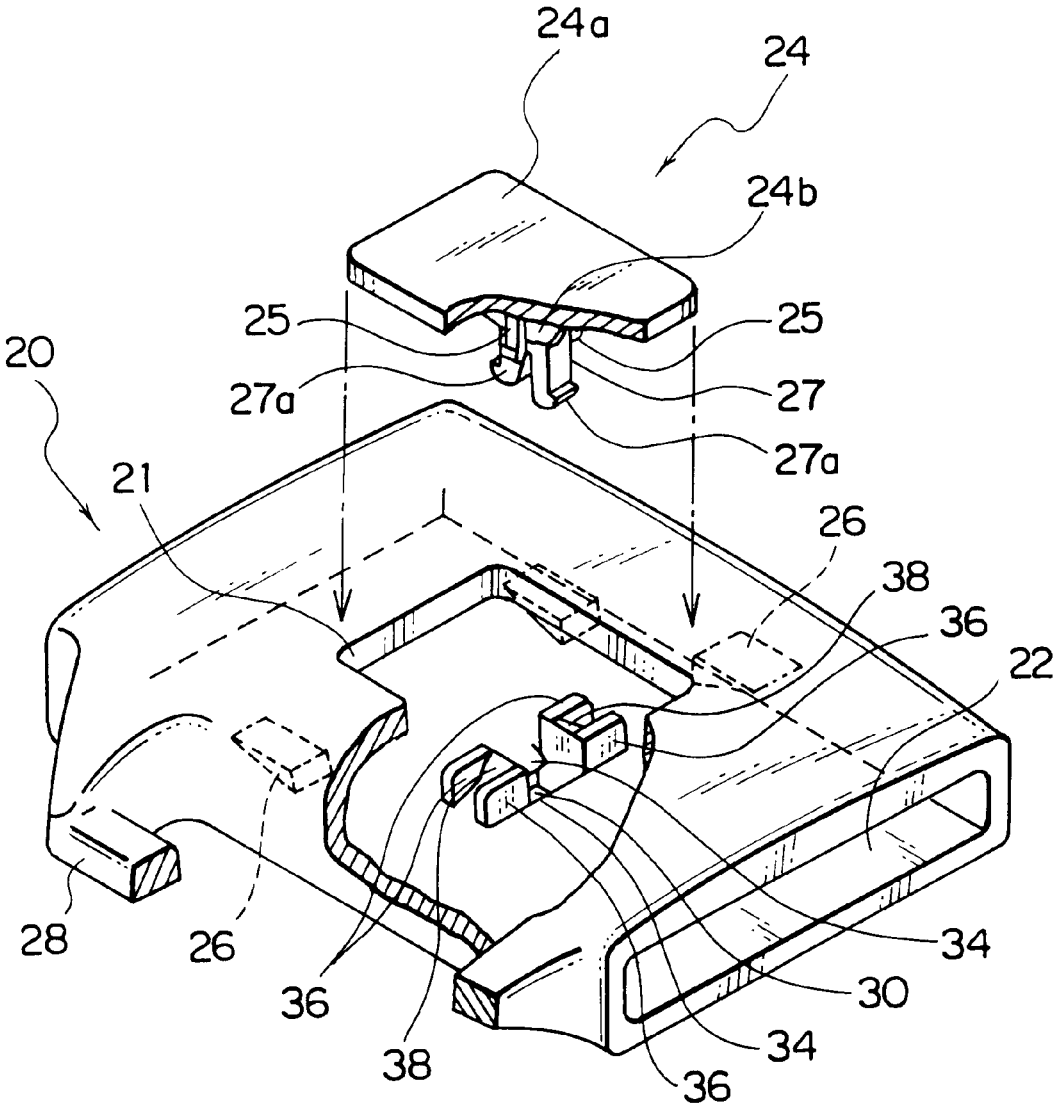
FIG. 1 is a partially cutaway perspective view of a socket of an embodiment of a buckle of the present invention.
Figure 2:
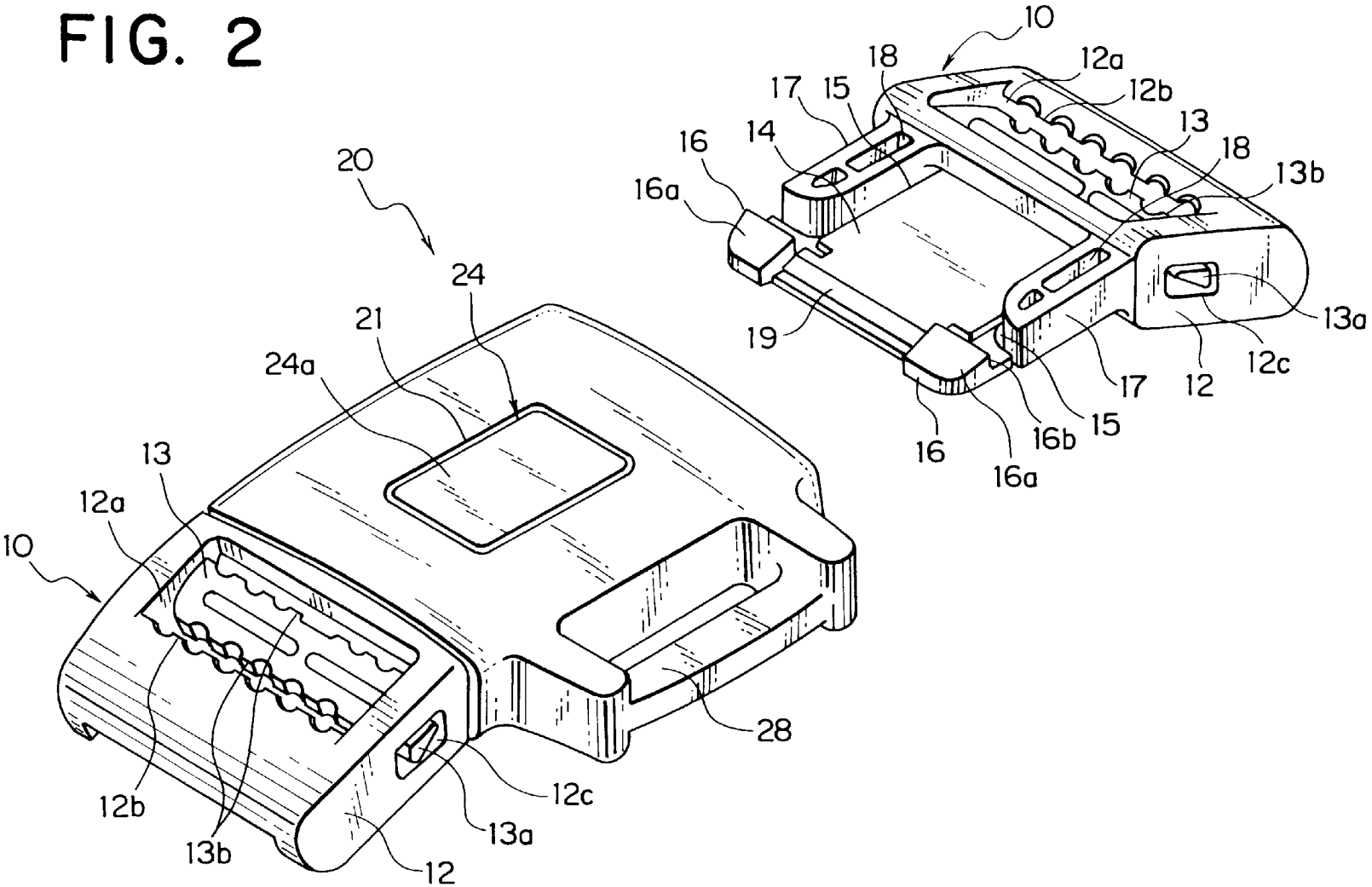
FIG. 2 is a perspective view of the embodiment of the buckle.
Figure 3:
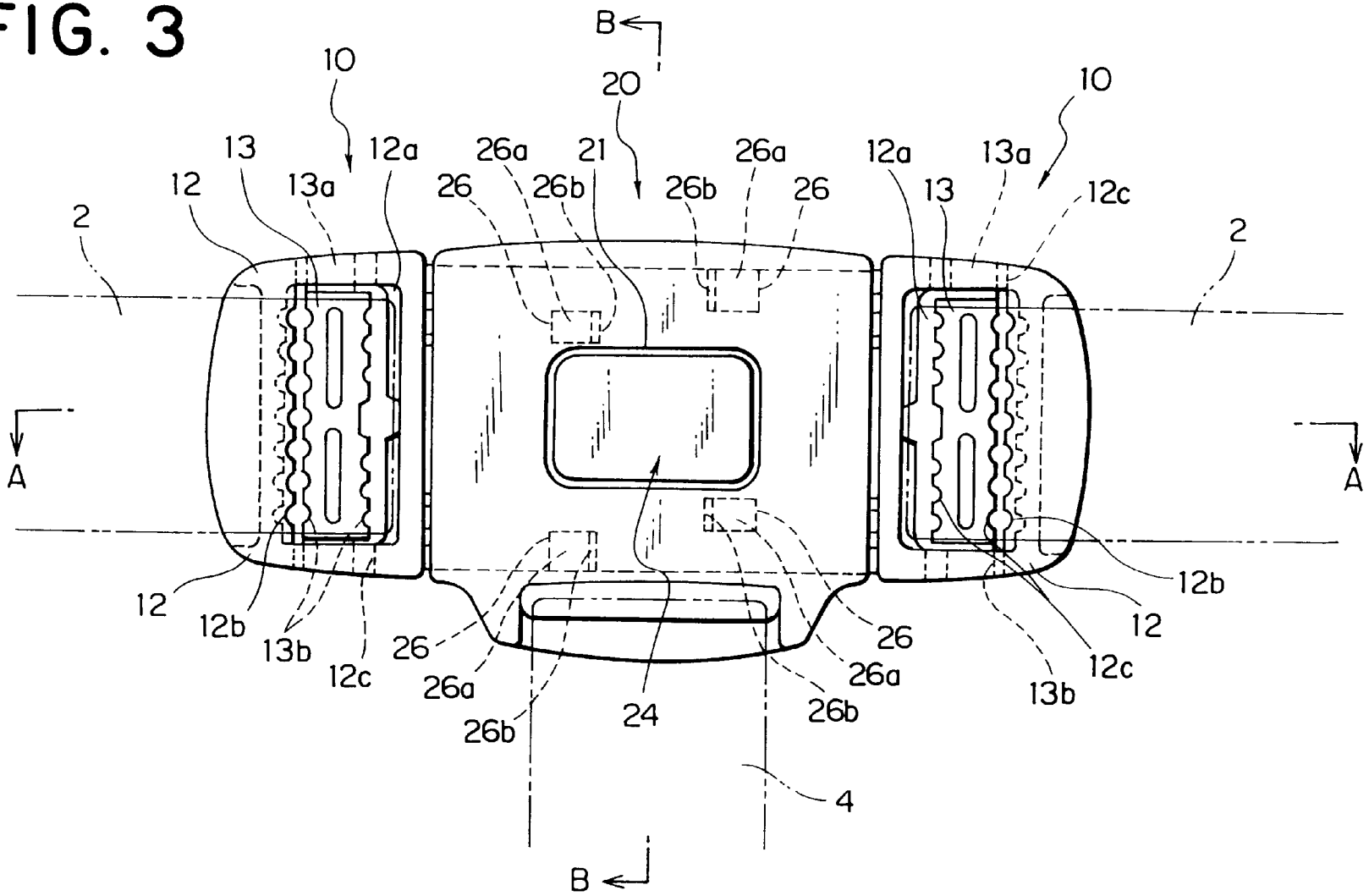
FIG. 3 is a plan view of coupled plugs and socket of the embodiment of the buckle.

An embodiment of the present invention will be described below based on the drawings. A buckle of the embodiment is used for a sheet belt of a vehicle or the like for securing a human body. As shown in FIG. 3, the buckle comprises a pair of plugs 10 which are made of resin and are respectively mounted to tip ends of a pair of straps 2 of three-point support straps and a socket 20 made of resin which is mounted to the other strap 4 and into and with which the plugs 10 are inserted and coupled. As shown in FIG. 2, each of the plugs 10 is integrally defined with a flat tongue 14 projecting from a strap attaching portion 12 at a base portion of the plug 10 and with a pair of support portions 17 projecting along notch portions 15 on both side portions of the tongue 14.

A pair of engaging portions 16 are formed on a front face side of a tip end portion of each the tongue 14 to extend from the opposite side portions toward a center portion of the tongue 14 with predetermined lengths, each the engaging portion 16 having an upper face 16*a* which slightly projecting upward and perpendicularly to a projecting direction of the tongue 14 and which slopes down in an inserting direction of the tongue 14 into the socket 20 and an engaging face 16*b* which is connected to the upper face 16*a* and is formed on a base end portion side of the tongue 14. The upper faces 16*a* of the pair of engaging portions 16 slope down in the inserting direction in a wedge shape, and the engaging faces 16*b* slope down from the upper face sides toward the tip end portion of the tongue 14. Between the pair of engaging portions 16, a tapered face 19 substantially in parallel to the upper faces 16*a* of the engaging portions 16 is formed at a predetermined distance from the tip end portion of the tongue 14.

Each of the support portion 17 on opposite sides of the tongue 14 is defined at a center portion thereof with a long and narrow groove portion 18. Width and height of the support portions 17 in a direction perpendicular to the inserting direction are substantially equal to width and height of a gap of inserting portions 22 of the socket 20 which will be described later. A recessed groove which is not described in the drawing which functions as a sliding portion which guides to the socket side at the time of insertion is defined on a rear face side of each the support portion 17. A pair of triangular ribs 14*c* for reinforcement are formed near opposite sides of a rear face side of the tongue 14 at a boundary portion between the base end portion of the tongue 14 and the strap attaching portion 12.

The strap attaching portion 12 of each the plug 10 slopes down toward a rear face side of the socket 20 with 23 degrees, for example, relative to an extending direction of the strap. The strap attaching portion 12 of each the plug 10 is defined with an attaching hole 12*a* into which a tip end portion of the strap 2 is inserted and a clamping portion 13 which can reciprocate and swing in a predetermined range of the attaching hole 12*a*. Opposite end portions 13*a* of the clamping portion 13 are loosely fitted into elongated holes 12*c* defined at side faces of the attaching hole 12*a*. The opposite end portions 13*a* of the clamping portion 13 is in a size that the opposite end portion 13*a* can move reciprocally in a predetermined distance of the elongated hole 12*c* and is in a sectional ellipse shape that the opposite end portion 13*a* can swing in a predetermined angle in the elongated hole 12*c*. An end portion of the attaching hole 12*a* in the extending direction of the strap 2 is defined with a serrated portion 12*b* which bites the strap 2. An end face of the clamping portion 13 which faces the serrated portion 12*b* and an opposite end face are defined with similar serrated portions 13*b*.

Figure 6:
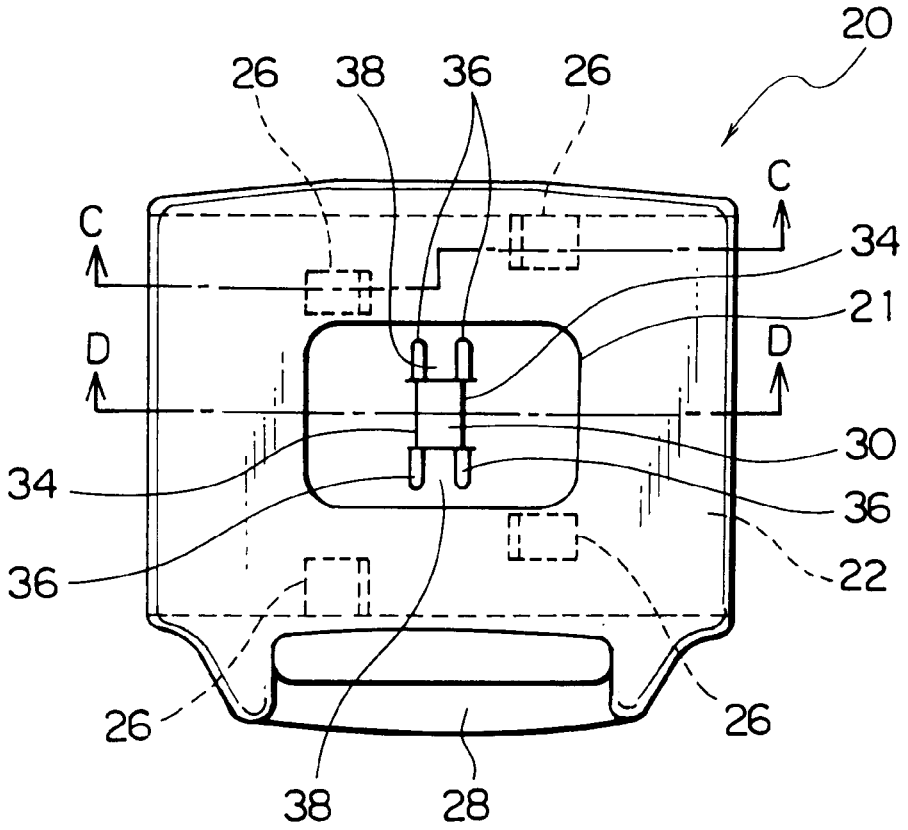
FIG. 6 is a front view of the socket of the embodiment of the buckle.
Figure 7:
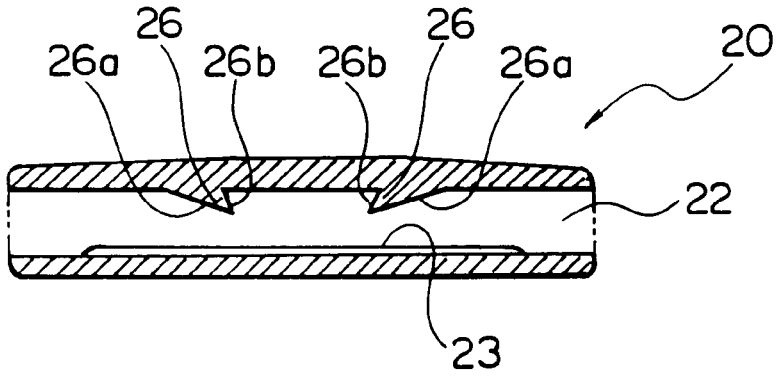
FIG. 7 is a sectional view taken along a line C—C in FIG. 6.
Figure 8:
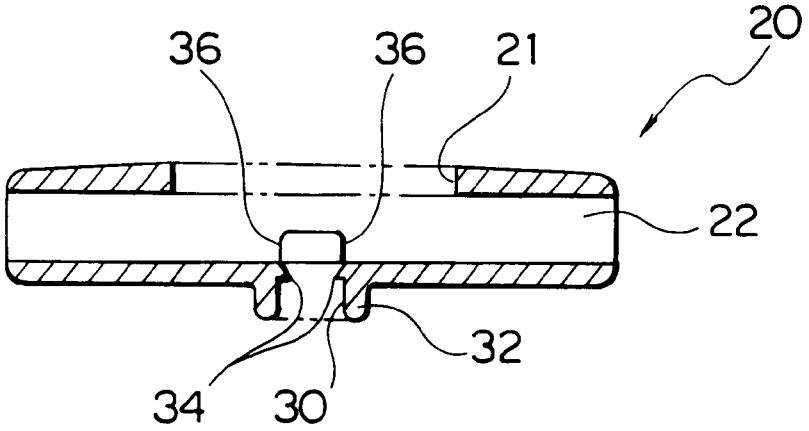
FIG. 8 s a sectional view taken along a line D—D in FIG. 6.
Figure 9:
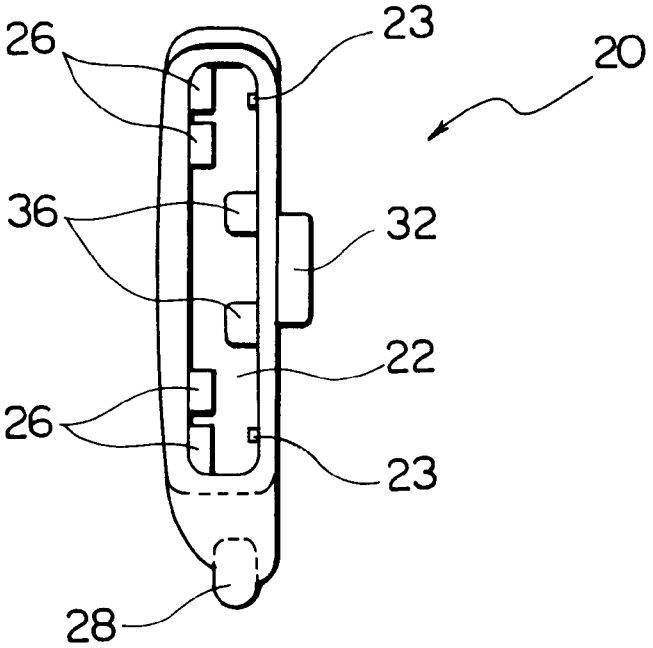
FIG. 9 is a right side view of the socket of the embodiment of the buckle.
Figure 10:
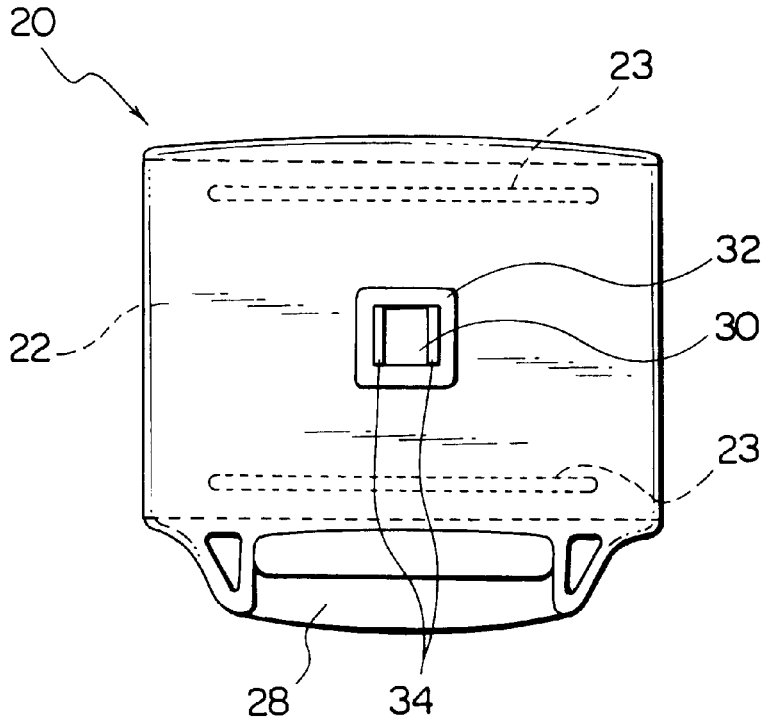
FIG. 10 is a bottom view of the socket of the embodiment of the buckle.

As shown in FIGS. 1, 6 to 10, and the like, the socket 20 is in a flat and hollow cylindrical shape. The hollow portions of the socket 20 are the inserting portions 22 for the plugs 10. Guide projecting streaks 23 as guide portions for guiding the plugs 10 are formed on an inner face of a rear face side of the inserting portions 22 in the inserting directions of the tongues 14 of the plugs 10. An operating hole 21 at which an operating portion 24 is positioned is formed at a center portion of the socket 20. The operating portion 24 is separated from the socket 20 and it will be described later. In an inner face of the inserting portions 22, two pairs of engaged portions 26 thereof to be engaged with a pair of engaging portions 16 of each the plug 10 are formed to project from an inner peripheral face of a front side of the socket 20. Above two pairs of engaged portions 26 face each other in pairs. The engaged portions 26 are fixed to the inserting portions 22 of the socket 20 and the engaged portions 26 do not overlap each other in the inserting directions of the plugs 10 into the inserting portions 22, as shown in FIG. 6. Furthermore, each the engaged portion 26 is defined with a slope 26*a* which slopes diagonally toward the rear face side in the inserting direction and which corresponds to a shape of the upper face 16*a* of each the engaging portion 16. In addition, each the engaged portion 26 is defined with an engaged face 26*b* which corresponds to a shape of the engaging face 16*b* of each the engaging portion 16 and which slopes in the inserting directions of the plugs 10 with a slight angle from a face perpendicular to the inserting directions.

A strap attaching portion 28 to be mounted with a strap 4 is formed on a side face of the socket 20 in a direction perpendicular to the inserting directions of the plugs into the inserting portions 22. A rectangular through hole 30 is defined on the rear face side of the socket 20 where a locking portion 27 of the operating portion 24 to be described later is to be fitted can project and sink freely. A protecting wall 32 is formed to surround a peripheral edge portion of the through hole 30 and to project outside the socket 20. Locked portions 34 are respectively formed on end edge portions of the through hole 30 perpendicular to the inserting directions of the plugs so as to project inward from inner side faces of the through hole 30. On an inner face of the socket 20, each pair of guide walls 36 are formed at each of end edge portions of the through hole 30 in parallel to the inserting directions of the plugs so as to extend away from the through hole 30. Between the pair of guide walls 36, a contact surface 38 which has the same height as the guide walls 36 on a side of the through hole 30 and which slopes down as it extends away from the through hole 30.

Figure 11:
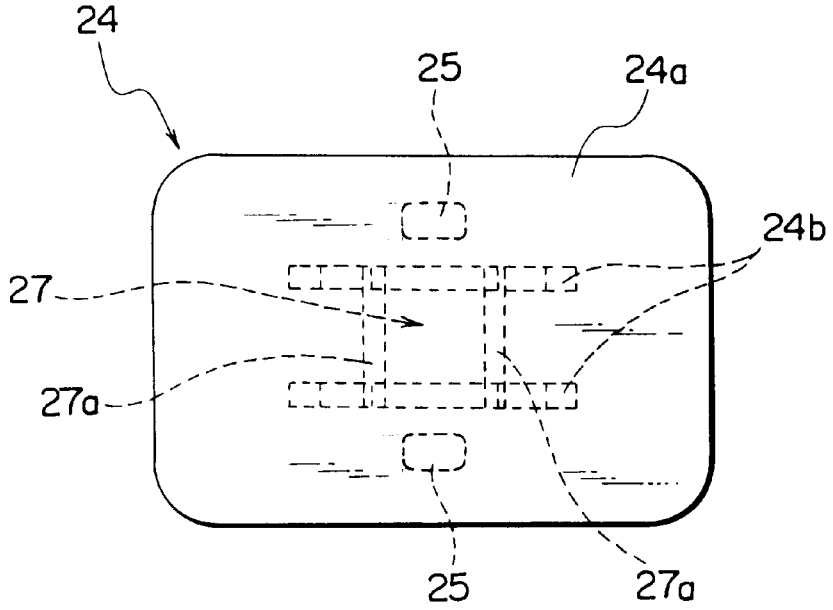
FIG. 11 is a front view of an operating portion of the embodiment of the buckle.
Figure 12:
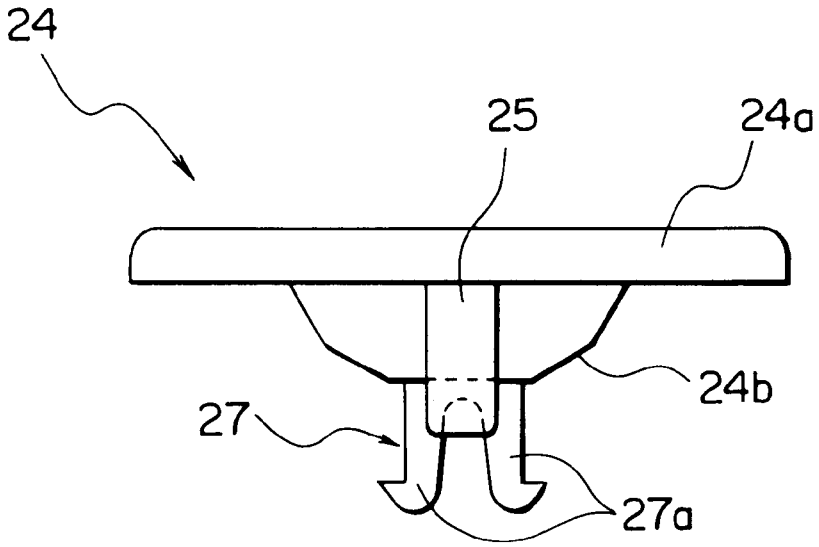
FIG. 12 is a bottom view of the operating portion of the embodiment of the buckle.

The operating portion 24 mounted in an operating hole 21 of the socket 20 comprises a plate-shaped operating chip or release button 24*a* which is exposed from the operating hole 21 as shown in FIGS. 11 and 12. Pushing portions 24*b* are integrally formed on the rear side of the operating chip 24*a* so as to push down the tongues 14 of the pair of plugs 10. The pushing portions 24*b* are in parallel to the inserting directions of the plugs 10 and a pair of the pushing portions 24*b* abut on the tapered faces 19 of the tongues 14. Each opposite end portions of the pushing portions 24*b* face the pair of tongues 14. Furthermore, between the pair of pushing portions 24*b*, the locking portion 27 having a pair of L-shaped portions 27*a* is formed integrally. Tip ends of the L-shaped portions 27*a* project in opposite directions in parallel to the inserting directions of the plugs 10.

Figure 13:
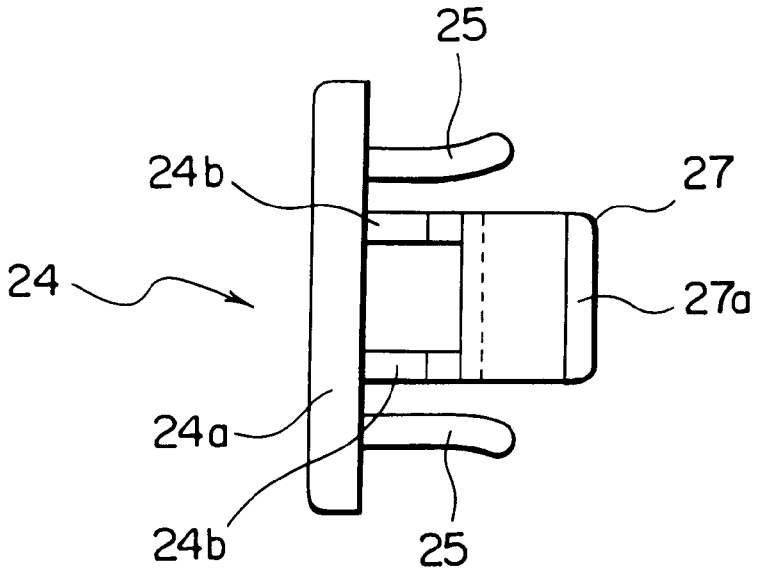
FIG. 13 is a right side view of the operating portion of the embodiment of the buckle.

On the rear side of the operating chip 24*a*, resilient portions 25 are respectively formed slightly outside of the pushing portions 24*b*. As shown in FIG. 13, the resilient portion 25 is a board having a sectional elliptical shape elongated in a direction parallel to the pushing portions 24*b* and projects substantially perpendicular from the operating chip 24*a*. Tip ends of the resilient portions 25 are curved slightly in directions away from each other.

Next, a method for manufacturing the buckle of the embodiment will be described below. First, the plugs 10 are molded simultaneously with the clamping portions 13 by a known injection molding. A slide core is positioned at a gap portion between each the elongated hole 12*c* and each of the opposite end portions 13*a* of the clamping portion 13, such that the clamping portion 13 is separated from the plug 10 after molded. The socket 20 is also molded by the known injection molding, wherein a pair of slide cores for forming the inserting portions 22 form opening portions on opposite sides of the inserting portions 22 and form engaged portions 26 at tip end portion of each slide core. At this time, because the engaged portions 26 are positioned alternately in sliding directions of the pair of slide cores for forming the inserting portions 22, the engaged portions 26 projecting inside the inserting portions 22 can be formed by only sliding each of the sliding cores to the left and right. Thus, the engaged portions 26 can be easily formed with a simple form.

The operating portion 24 is also molded by the known injection molding. The operating portion 24 is mounted to the socket 20 by fitting and pushing the operating portion 24 into the operating hole 21 of the socket 20 from above such that the L-shaped portions 27*a* of the locking portion 27 projecting from the operating portion 24 are engaged with the engaged portions 34 at the inner faces of the through hole 30 of the socket 20. At this time, the pair of resilient portions 25 of the operating portion 24 abut on the contact surfaces 38 of the socket 20 to be pushed and resiliently deformed to both sides such that the resilient portions 25 are stretched toward opposite sides. As a result, a biasing force is applied outward from the operating hole 21 of the socket 20 to the resilient portions 25.

Figure 4:
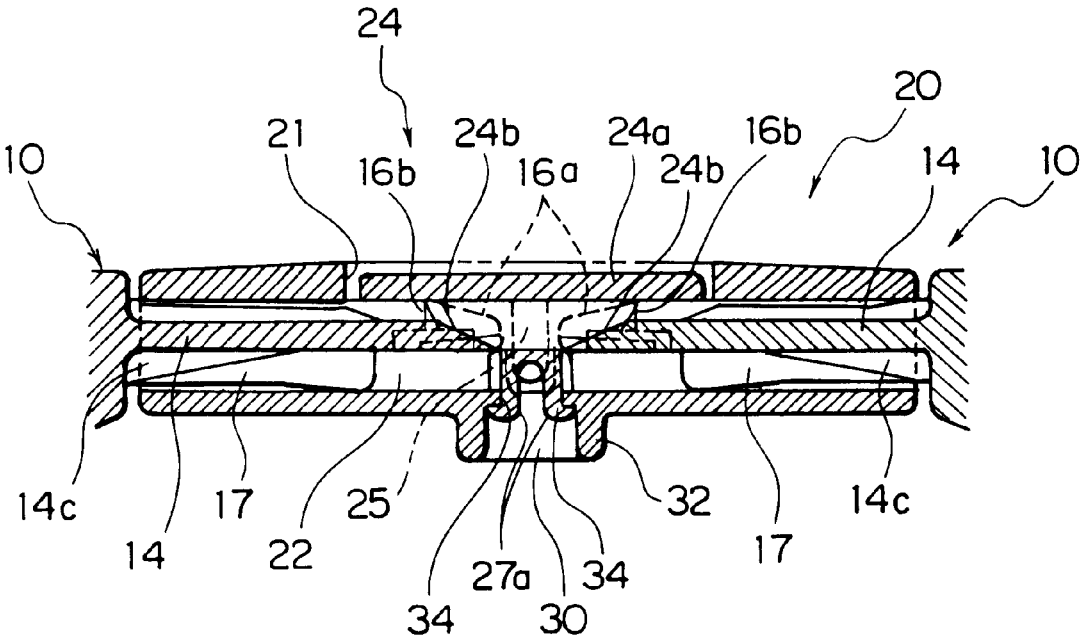
FIG. 4 is a sectional view taken along a line A—A in FIG. 3.
Figure 5:
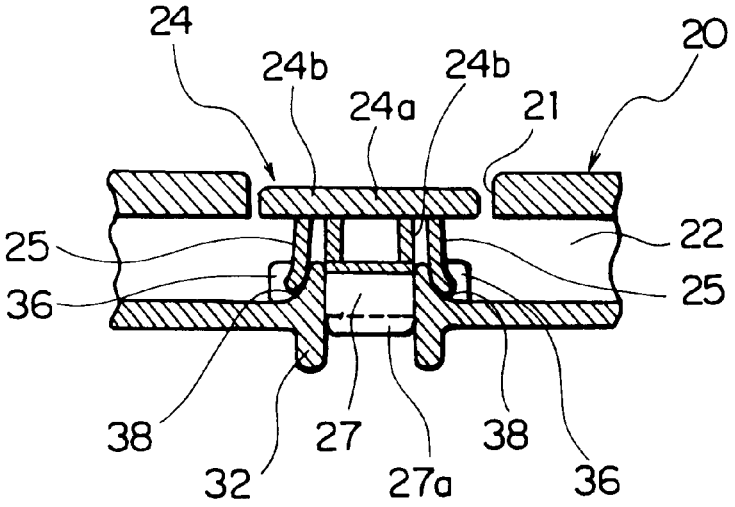
FIG. 5 is an enlarged sectional view taken along a line B—B in FIG. 3.

Usage of the buckle of the embodiment will be described below. In order to mount the plug 10 into the socket 20, the tongue 14 is inserted into the inserting hole of the inserting portion 22, as shown in FIG. 2. At this time, the recessed grooves on the rear face side of the support portions 17 are guided by the projection streaks 23 of the inserting portion 22 so as to allow the tongue 14 to be smoothly inserted into the inserting portion 22. Then, the engaging portions 16 of the tongue 14 abut on the engaged portions 26. If the plug 10 is further pushed in this state, the upper faces 16*a* of the engaging portions 16 are pushed down along the slopes 26*a* of the engaged portions 26. If the plug 10 is further pushed, the engaging portions 16 climb over the engaged portions 26 such that the engaging faces 16*b* face the engaged faces 26*b*, thereby completing engagement, as shown in FIG. 4. This engagement is carried out by a temporary and resilient displacement of the engaging portions 16 relative to the engaged portions 26. Therefore, the pair of plugs 10 can be separately and reliably engaged with the socket 20. Positioning of the engaged plugs 10 and socket 20 is firmly and stably maintained, because the plugs 10 are fixed to the socket 20 by the support portions 17.

In order to disengage coupling, by pushing the operating chip 24*a* of the operating portion 24, the pushing portions 24*b* push the tip end portions of the tongues 14, thereby the tongues 14 resiliently deform toward the rear face side. In this state, because the slopes of the pushing portions 24*b* are in resilient contact with the tip end portions of the tongues 14, forces act on the plugs 10 in such a direction that the plugs 10 jump out of the inserting portions 22 due to the resilient forces. Thus, the engaging portions 16 and the engaged portions 26 are disengaged, thereby pushing the plugs 10 out of the socket 20. Because the pushing portions 24*b* face the tip end portions of the tongues 14, engagements of the pair of plugs 10 are simultaneously disengaged and the plugs 10 are pushed outward by pushing the operating chip 24*a*.

A strap 2 mounted to each the plug 10 of the embodiment is wound around the clamping portion 13 and reliably maintained between the attaching hole 12*a* of the strap attaching portion 12 and the clamping portion 13. At this time, if a base end portion side of the strap 2 is pulled, a moment acts on the clamping portion 13 such that the acute angle portions of the clamping portion 13 are pushed against an inner wall face of the attaching hole 12*a*, and the serrated portions 12*b* and 13*a* of the strap attaching portion 12 and the clamping portion 13 clamp the strap 2 with the above moment, thereby further reliably mounting the strap 2. Particularly, even if the strap 2 is pulled toward the rear face side of the strap attaching portion 12 further direction of the attaching portion 12, the strap 2 is not drawn out because a force in a direction as to clamp the strap 2 between the clamping portion 13 and a side face of the attaching hole 12*a* is applied to the clamping portion 13 by a tension of the strap 2.

According to the buckle of the embodiment, the operating portion 24 can be mounted to the socket 20 by a simple operation of inserting and pushing the operating chip 24*a* into the operating hole 21 of the socket 20. Therefore, the operation can be efficiently carried out in a short time. Furthermore, because the operating portion 24 is separated from the socket 20, it is possible to form a buckle in a structure of easy operation. The operating portion 24 can be molded with material and a color which are different from those of the socket 20, and appropriate functions may be applied to the operating portion 24. Because the engaged portions 26 with which the engaging portions 16 of the plugs 10 are engaged are formed integrally with the socket 20 and the plugs 10 are mounted to the socket 20 by the support portions 17, engagements of the plugs are not influenced by "wear-out" which may be generated with the resilient portions 25 of the operating chip 24 and the plugs 10 can be reliably engaged with the socket 20.

When the operating chip 24*a* is pushed down it descends evenly without tilting. Therefore, the tongues 14 of the pair of plugs 10 are pushed substantially simultaneously with the same force, thereby disengage engagements of the plugs 10 with the socket 20. Because the pair of plugs 10 jump out of the socket 20 substantially simultaneously, the buckle has a desirable operability and is easy to use. Furthermore, two resilient portions 25 are disposed symmetrically with each other, it is possible to obtain equal and sufficient strength to the pushing direction. Furthermore, because the protecting wall 32 is formed on the peripheral edge portion of the through hole 30 of the socket 20 so as to project outward, even if the locking portion 27 of the operating portion 24 projects outside the socket 20, the resilient portions 25 will not be caught on clothes or fingers, and the buckle is safe. Because the operating chip 24*a* is located slightly inside from a surface of the socket 20, the operating chip 24*a* will not stripped off from the operating hole 21 of the socket 20. The operating portion 24 can be mounted to the socket 20 by a simple operation of inserting and pushing the operating chip 24*a* into the operating hole 21 of the socket 20. Therefore, the operation can be efficiently carried out in a short time.

The buckle of the invention is not limited to the above embodiment, but the tongues may be rigid relative to the strap attaching portions, and the support portions may be resilient. In this case, when the plugs are inserted into the socket, the support portions are resiliently deformed and the plugs are inserted while swinging at the time of insertion. Furthermore, the shapes of the resilient portion, the contact surfaces, and the guide walls can be properly determined, and they can be formed at any positions such that they do not hinder engagements of the plugs with the socket and that the operating portion has a both-end supported structure. The resilient portion formed on the operating portion may be formed on the socket and the contact surfaces formed on the socket may be formed on the operating portion. For example, the resilient portion may be formed to project from an inside of a bottom face of the socket toward the operating chip, and the contact surfaces may be formed on the rear face of the operating chip. Furthermore, a number of the resilient portions may be properly changed, if the operating chip is pushed to be displaced for disengaging the engagements, and if the operating chip is displaced evenly without tilting.

In the buckle of the invention, the operating portion is formed separately from the socket, thereby improving assembly property and operability. Particularly, because the engaged portions are formed on an inner face side of the socket, force for maintaining the plugs and maintaining and resilient force for the operating portion can be set separately. Therefore, even if one force is damaged, the other forces will not be affected, thereby providing a safe buckle. Also, because the operating portion is separated from the socket and can be smaller in size, the operating portion can be mounted to the socket by inserting the operating portion into the operating hole of the socket from above. Thereby providing extremely easy and reliable in assembling.

Because the pair of resilient portions of the operating portion is formed symmetrical with each other, when the operating chip is pushed down, it evenly descends without tilting. The pair of plugs are substantially simultaneously pushed with the same force, thereby substantially simultaneously disengaging engagements of the plugs with the socket. Because the pair of plugs are pushed substantially simultaneously with the same force and jump out of the socket substantially simultaneously, the buckle has a desirable operability.

Moreover, because the projecting protecting wall is formed on the rear face side of the socket, even if the locking portion of the operating portion projects toward the rear face side due to a pushing operation of the operating portion, the locking portion will not be caught by anything, and the buckle is safe.

What is claimed is:

1. A buckle comprising a pair of plugs mounted to each of end portions of a pair of straps, a socket mounted to an end portion of another strap, a strap attaching portion formed at a base portion of each of said plugs, a tongue formed to project from each said strap attaching portion and to be inserted into said socket, an engaging portion formed at a tip end portion of each said tongue, inserting portions which are formed in said socket to penetrate said socket and to face each other and into which said tongues are inserted respectively, fixed engaged portions which are formed in said inserting portions and with which said engaging portions of said plugs are engaged, and an operating portion which is formed between said engaged portions and which displaces said engaging portions to disengage engagements of said engaging portions with said engaged portions, wherein said operating portion is formed separately with said socket and comprises a release button exposed to an outer surface of an operating hole of said socket, pushing portions integrally formed on a rear face side of said release button, and a locking portion to be locked in said socket to prevent disengaging from said socket, a resilient portion is formed on at least one of said release button and said socket so as to abut on the other of said release button and said socket and to bias said operating portion outward.

2. A buckle according to claim 1, wherein a pair of said resilient portions are disposed symmetrically with respect to said release button, and contact surfaces on which tip ends of said resilient portions abut and which are slopes for resiliently deforming said resilient portions are formed at portions on which said pair of resilient portions abut.

3. A buckle according to claim 2, wherein a pair of guide walls for guiding opposite sides of each said resilient portion are formed at opposite side portions of each said contact face.

4. A buckle according to any one of claims 1, 2, or 3, wherein said locking portion extends toward a rear face side of said socket, a through hole into which said locking portion can be inserted is formed at a rear face of said socket, and said locking portion is locked at an inner side portion of said through hole.

5. A buckle according to claim 1, wherein the operating portion is separate from and engaged with the socket.

* * * * *